US007833067B1

(12) United States Patent
Villa

(10) Patent No.: US 7,833,067 B1
(45) Date of Patent: Nov. 16, 2010

(54) AUDIO-VIDEO SIGNAL PLUG

(76) Inventor: Robert F Villa, 1006 5th St., Greeley, CO (US) 80631

( * ) Notice: Subject to any disclaimer, the term of this patent is extended or adjusted under 35 U.S.C. 154(b) by 0 days.

(21) Appl. No.: 12/581,146

(22) Filed: Oct. 18, 2009

(51) Int. Cl.
*H01R 24/04* (2006.01)

(52) U.S. Cl. ..... 439/669

(58) Field of Classification Search ..... 439/669, 439/581, 63, 578, 668, 675
See application file for complete search history.

(56) References Cited

U.S. PATENT DOCUMENTS 7,001,220 B2 * 2/2006 Thorner et al. ..... 439/675
7,150,648 B1 * 12/2006 Hall et al. ..... 439/581
7,294,022 B1 * 11/2007 Cheng ..... 439/668
7,425,153 B1 * 9/2008 Miller ..... 439/578

* cited by examiner

*Primary Examiner*—Jean F Duverne

(57) ABSTRACT

An audio-video signal plug includes a shaft assembly comprising a shaft body, a shaft carried by the shaft body and a quick disconnect blade connector carried by the shaft body and disposed in electrical communication with the shaft.

9 Claims, 3 Drawing Sheets

AUDIO-VIDEO SIGNAL PLUG

FIELD OF THE INVENTION

The present disclosure relates to plugs used to connect signal routing cables in audio-video applications. More particularly, the present disclosure relates to an audio-video signal plug which utilizes quick-disconnect couplers for connection to a signal routing cable.

BACKGROUND OF THE INVENTION

Audio-video signal plugs are used to connect signal routing cables to components such as digital playing devices and monitors or speakers. The audio-video signal plug is commonly attached to the end of the signal routing cable by soldering. However, soldering of the plug to the signal routing cable may have drawbacks in making custom-length audio and video signal routing cables.

Therefore, an audio-video signal plug which utilizes quick-disconnect couplers for connection to a signal routing cable is needed to enable consumer electronics enthusiasts or professional technicians to make custom length audio and video signal routing cables without the requirement of soldering the plug to the cable.

SUMMARY

The present disclosure is generally directed to an audio-video signal plug for a signal routing cable. An illustrative embodiment of the audio-video signal plug includes a shaft assembly comprising a shaft body, a shaft carried by the shaft body and a quick disconnect blade connector carried by the shaft body and disposed in electrical communication with the shaft for connection to the signal routing cable.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description. As used herein, relative terms such as "horizontal", "vertical", "top", "bottom", "upper", "lower", "upwardly", "downwardly", "front", "rear" and "side" are used for descriptive purposes only and not in a limiting sense.

Figure 1:
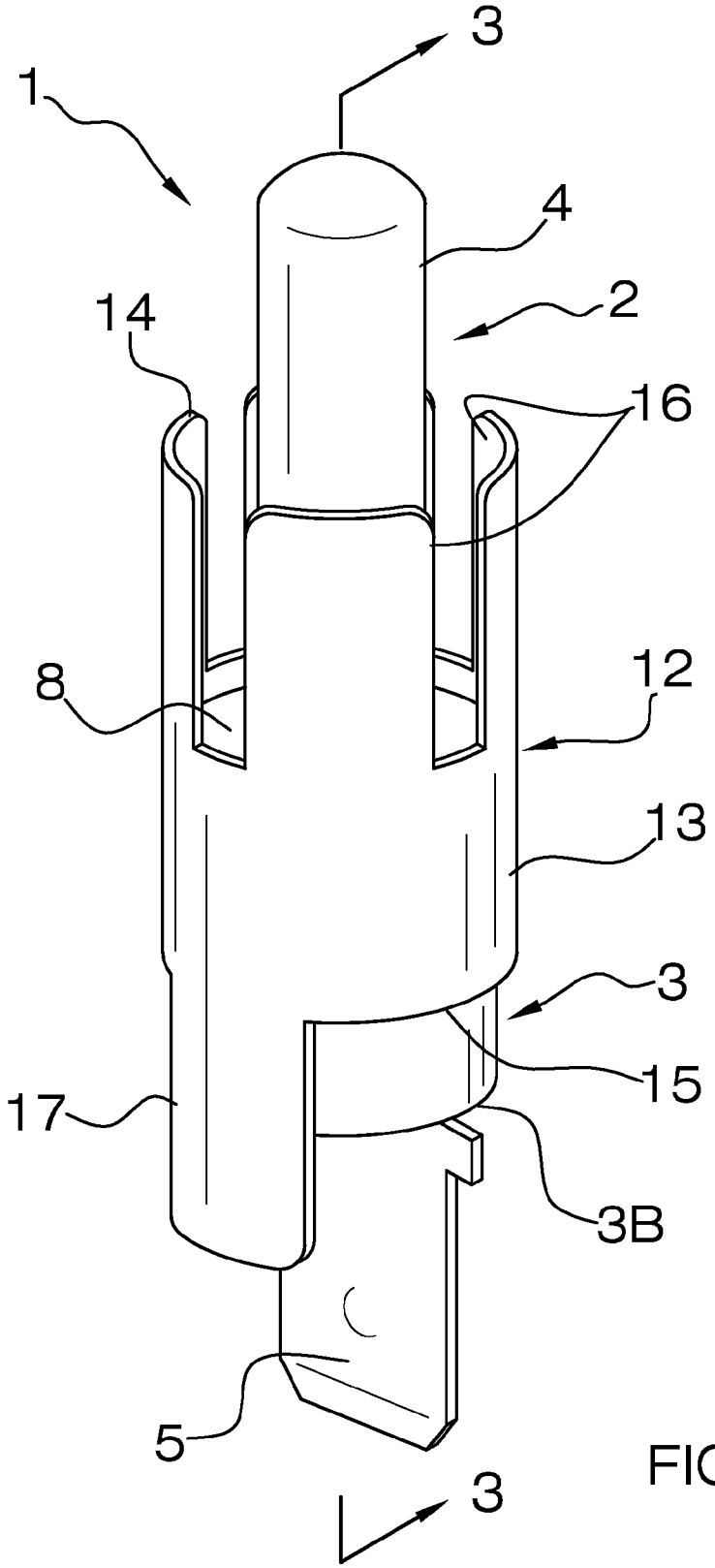
FIG. 1 is a perspective view of an illustrative embodiment of the audio-video signal plug.
Figure 2:
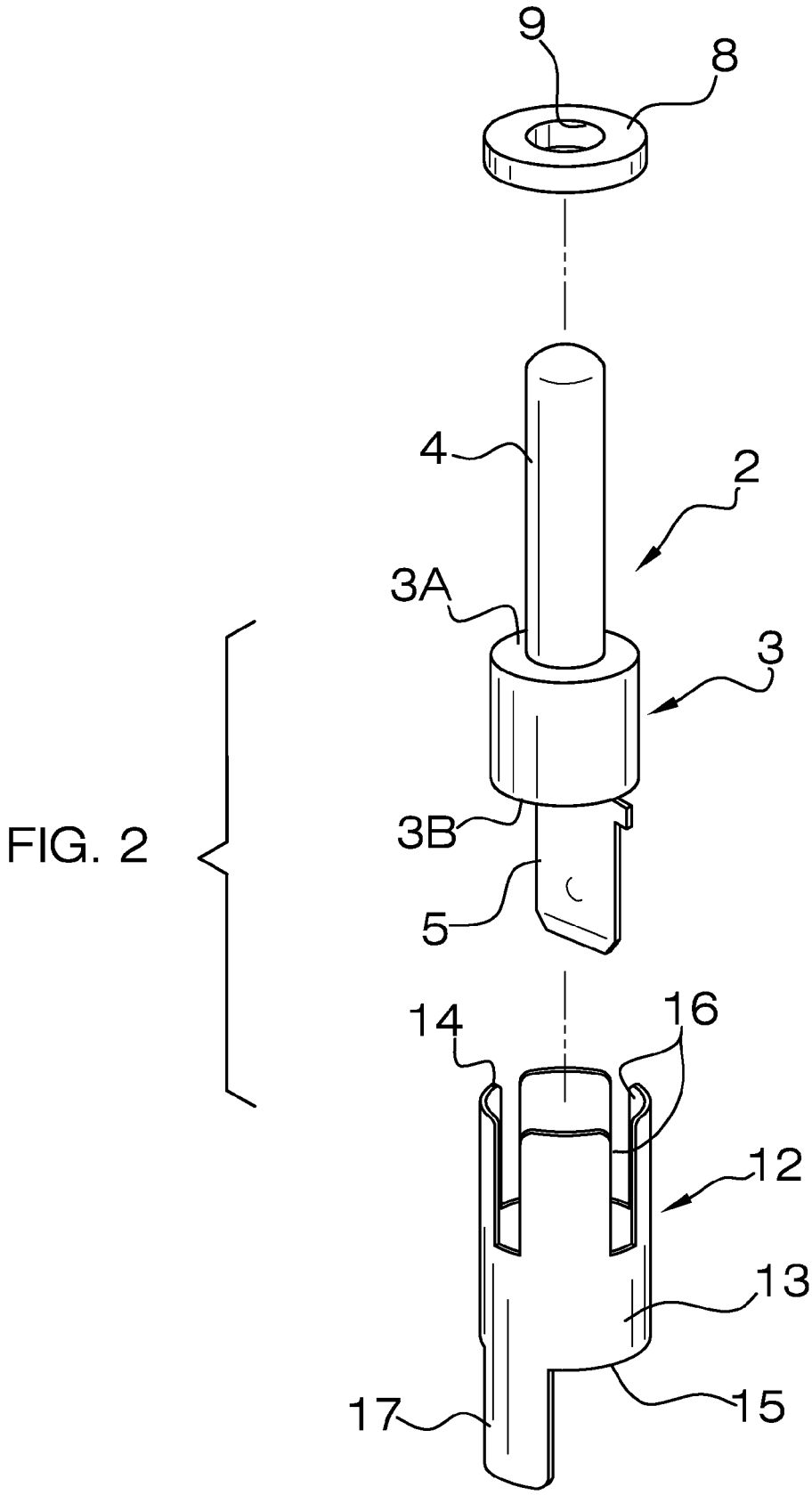
FIG. 2 is an exploded perspective view of an illustrative embodiment of the audio-video signal plug.
Figure 3:
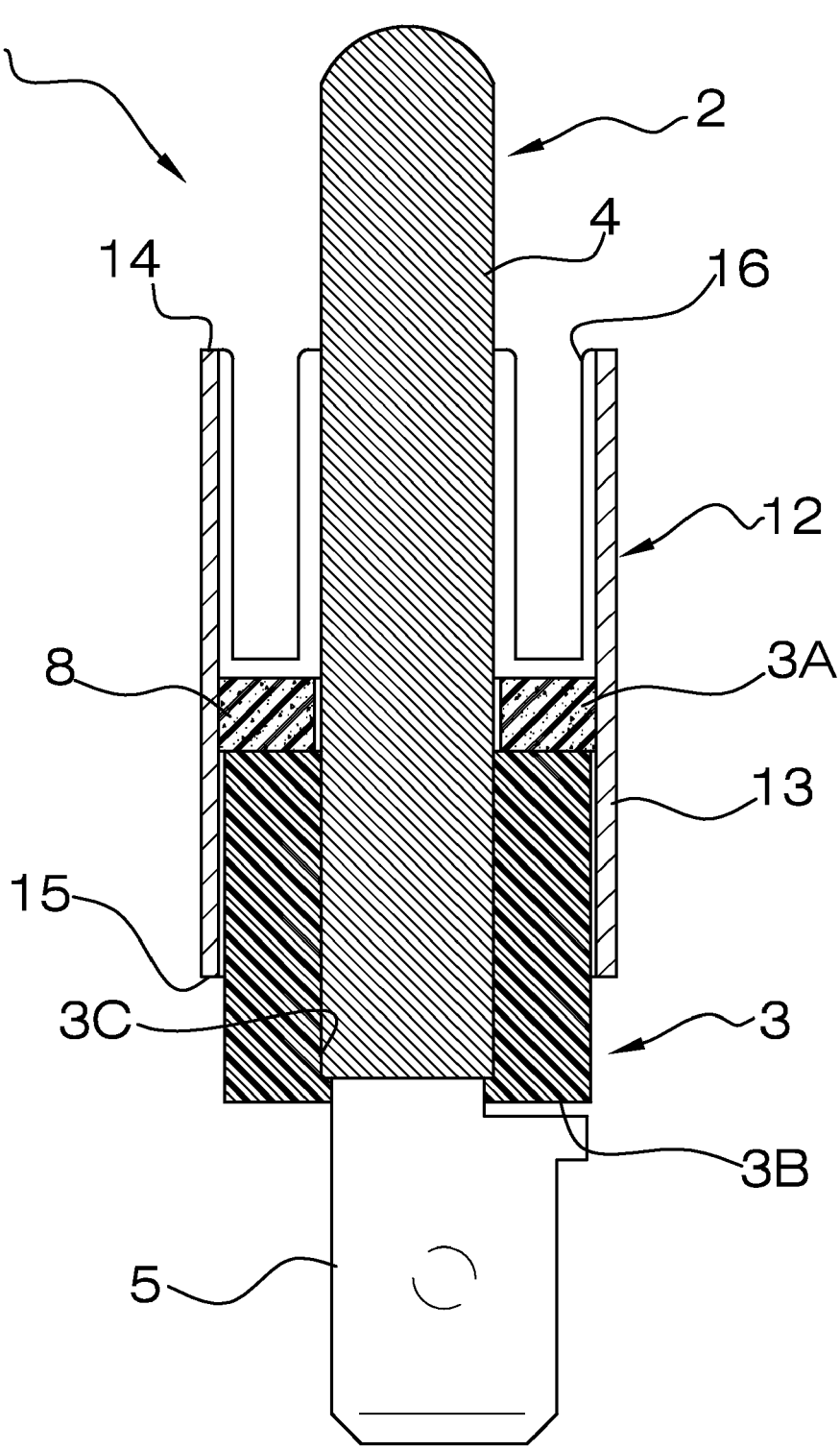
FIG. 3 is a longitudinal sectional view, taken along section lines 3-3 in FIG. 1, of an illustrative embodiment of the audio-video signal plug.

Referring to the drawings, an illustrative embodiment of the audio-video signal plug is generally indicated by reference numeral 1. The audio-video signal plug 1 includes a shaft assembly 2 having a shaft body 3 which may be generally cylindrical. As shown in FIGS. 2 and 3, the shaft body 3 may have a shaft end 3*a* and a blade end 3*b* opposite the shaft end 3*a*. As shown in FIG. 3, a shaft bore 3*c* may extend through the shaft body 3 from the shaft end 3*a* to the blade end 3*b*.

An elongated shaft 4 may extend through the shaft bore 3*c* and protrude beyond the shaft end 3*a* of the shaft body 3. The shaft 4 may be secured in the shaft bore 3*c* of the shaft body 3 using welding, soldering, fasteners and/or other suitable attachment technique. A male quick disconnect blade connector 5 is disposed in electrical communication with the shaft 4 and may extend beyond the blade end 3*b* of the shaft body 3.

An electrical insulator 8 may be provided on the blade end 3*a* of the shaft body 3. The insulator 8 may be ceramic or other electrically-insulating material. The insulator 8 may have a central insulator opening 9 which receives the shaft 4 of the shaft assembly 2.

In some embodiments, a plug housing 12 may partially enclose the shaft body 3 and the shaft 4 of the shaft assembly 2. The plug housing 12 may include a generally cylindrical housing body 13 having a shaft end 14 and a connector end 15. In some embodiments, multiple housing slots 16 may extend into the shaft end 14 of the plug housing 12. A strain relief tab 17 may extend from the connector end 15, generally adjacent to the shaft body 3 and the male quick disconnect blade connector 5 of the shaft assembly 2.

In typical use, audio-video signal plugs 1 are connected to respective ends (not shown) of a signal routing cable. Female quick disconnect elements (not shown), which may be conventional, may be provided on the respective ends of the signal routing cable. Accordingly, the audio-video signal plugs 1 may be coupled to the respective ends of the signal routing cable by causing engagement of the male quick disconnect blade connector 5 of each audio-video signal plug 1 with the companion female quick disconnect element provided on the corresponding end of the signal routing cable. The strain relief tab 17 may prevent excessive crimping or twisting of the signal routing cable.

The signal routing cable may then be used to connect various components of an audio and/or video system (not shown) by inserting each audio-video signal plug 1 into a jack (not shown) provided in the respective components of the system which are to be connected. It will be appreciated by those skilled in the art that the quick disconnect coupling of the audio-video signal plugs 1 to the signal routing cable permits consumer electronics enthusiasts, professional technicians and the like to fabricate custom-length audio and video signal routing cables without any soldering effort.

In some embodiments, a female quick disconnect element (not shown) may be provided on each audio-video signal plug 1 in place of the male quick disconnect blade connector 5. A male connector such as the male quick disconnect blade connector 5 may be provided on each end of the signal routing cable. In that case, each audio-video signal plug 1 may be coupled to the corresponding end of the signal routing cable by connecting the male connector on each audio-video signal plug 1 with the companion female quick disconnect element on each corresponding end of the signal routing cable.

What is claimed is:

1. An audio-video signal plug, comprising:

a shaft assembly comprising:

a shaft body; said shaft body has a shaft end and a blade end opposite said shaft end and said shaft protrudes beyond said shaft end and said quick disconnect blade connector protrudes beyond said blade end;

a shaft carried by said shaft body; and a quick disconnect blade connector carried by said shaft body and disposed in electrical communication with said shaft.

2. The audio-video signal plug of claim 1 further comprising a shaft bore extending through said shaft body and wherein said shaft extends through said shaft bore.

3. The audio-video signal plug of claim 1 wherein said quick disconnect blade connector comprises a male quick disconnect blade connector.

4. The audio-video signal plug of claim 1 further comprising an electrical insulator carried by said shaft body.

5. The audio-video signal plug of claim 1 further comprising a plug housing partially enclosing said shaft body and said shaft of said shaft assembly.

6. The audio-video signal plug of claim 5 further comprising a strain relief tab extending from said plug housing generally adjacent to said shaft body.

7. An audio-video signal plug, comprising:

a shaft assembly comprising:

a generally cylindrical shaft body having a shaft end, a blade end opposite said shaft end and a shaft bore extending through said shaft body between said shaft end and said blade end;

a shaft extending through said shaft bore and protruding beyond said shaft end of said shaft body;

a quick disconnect blade connector disposed in electrical communication with said shaft and protruding beyond said blade end of said shaft body; and an electrical insulator having an insulator opening receiving said shaft and engaging said shaft end of said shaft body; and a plug housing comprising:

a generally cylindrical housing body partially enclosing said shaft body and said shaft of said shaft assembly and having a shaft end and a connector end opposite said shaft end; and a plurality of housing slots provided in said shaft end of said housing body.

8. The audio-video signal plug of claim 7 further comprising a strain relief tab extending from said connector end of said housing body of said plug housing generally adjacent to said shaft body.

9. The audio-video signal plug of claim 7 wherein said quick disconnect blade connector comprises a male quick disconnect blade connector.

* * * * *